US007055714B2

(12) United States Patent
Perelli et al.

(10) Patent No.: US 7,055,714 B2
(45) Date of Patent: Jun. 6, 2006

(54) SMOKING-WASTE RECEPTACLE

(75) Inventors: Thomas Perelli, Winchester, VA (US); Craig Demko, Winchester, VA (US); Craig Rogers, Winchester, VA (US)

(73) Assignee: Rubbermaid Commercial Products LLC, Winchester, VA (US)

( * ) Notice: Subject to any disclaimer, the term of this patent is extended or adjusted under 35 U.S.C. 154(b) by 306 days.

(21) Appl. No.: 10/402,985

(22) Filed: Apr. 1, 2003

(65) Prior Publication Data

US 2004/0026290 A1 Feb. 12, 2004

Related U.S. Application Data

(60) Provisional application No. 60/401,031, filed on Aug. 6, 2002, provisional application No. 60/447,708, filed on Feb. 19, 2003.

(51) Int. Cl.
*B65F 1/08* (2006.01)

(52) U.S. Cl. ..... 220/576

(58) Field of Classification Search ..... 220/576, 220/560.01; 232/43.2
See application file for complete search history.

(56) References Cited

U.S. PATENT DOCUMENTS

| | | | |
|---|---|---|---|
| 61,393 | A | 1/1867 | Burns |
| D61,393 | S | 8/1922 | Johnson |
| 1,511,217 | A | 10/1924 | Floercky |
| 1,559,234 | A | 10/1925 | Fleming |
| 1,569,603 | A | 1/1926 | Anderson |
| 1,574,599 | A | 2/1926 | Briscoe |
| 1,645,525 | A | 10/1927 | Fleming |
| 1,646,086 | A | 10/1927 | Fleming |
| 1,646,099 | A | 10/1927 | Mitchell |
| 1,662,171 | A | 3/1928 | Savery |
| 1,670,525 | A | 5/1928 | Savery |
| 1,735,671 | A | 11/1929 | Bunker |
| 1,807,079 | A | 5/1931 | Wilmanns |
| 1,907,788 | A | 5/1933 | Goertz et al. |
| D105,097 | S | 6/1937 | Gray |
| 2,110,773 | A | 3/1938 | Nelson |

(Continued)

FOREIGN PATENT DOCUMENTS

AU 734 628 B2 6/2001

(Continued)

OTHER PUBLICATIONS http://www.rcpworksmarter.com/rcp/products/detail.jsp?categoryID=4&subcategoryID=238&rcpNum=2570, 2570 GroundsKeeper™ Cigarette Waste Collector.

(Continued)

*Primary Examiner*—Stephen Castellano
(74) *Attorney, Agent, or Firm*—Foley & Lardner LLP

(57) ABSTRACT

A smoking-waste receptacle includes a housing and a container for receiving smoking waste and that can be inserted into and removed from the housing. The container includes a removal opening that permits removal of smoking waste deposited in the container and a door movable relative to the removal opening and configured to cover the removal opening when the container is disposed in the housing. The container can include a container body and flow-inhibiting structure disposed within the container body to inhibit smoke from leaving the container body. The container can includes a first wall extending substantially vertically, a first insertion opening in the first wall that allows smoking waste to be inserted into the container, and a first snuff member disposed within the container and adjacent the first insertion opening at a position that permits smoking waste that has been inserted into the first insertion opening to be pushed against the first snuff member.

28 Claims, 14 Drawing Sheets

U.S. PATENT DOCUMENTS

| | | | |
|---|---|---|---|
| D143,018 | S | 11/1945 | Mankki |
| 2,567,166 | A | 9/1951 | Dick |
| 2,716,414 | A | 8/1955 | Nelson |
| 2,842,280 | A | 7/1958 | Nelson |
| 3,523,640 | A | 8/1970 | Roth |
| 4,772,869 | A | 9/1988 | Grammas et al. |
| 4,920,988 | A | 5/1990 | Cancellara |
| D389,600 | S | 1/1998 | Luedecke |
| D397,496 | S | 8/1998 | Luedecke |
| 6,186,355 | B1 | 2/2001 | Luedecke |
| D452,929 | S | 1/2002 | Perelli |

FOREIGN PATENT DOCUMENTS

| | | |
|---|---|---|
| DE | 1 187 052 | 2/1965 |
| EP | 0 647 412 A1 | 4/1995 |
| WO | WO 94/18859 A1 | 9/1994 |
| WO | WO 97/25887 A1 | 7/1997 |

OTHER PUBLICATIONS

Kippy, The End of Every Cigarette, Order Form, Kippy International Design.

Kippy, The End of Every Cigarette, Description of Product, Kippy International Design.

Johnsons Environmental Products, Inc., Cigarette Disposal Unit.

Butt Stop, http://www.buttstop.com/buttstop.htm.

SAFCO, Smoker Dome, Smoker Mate Ash Urn, Smoker Mate Ash Urn Stand, Economy Ash & Ash 'N Trash Urns. http://www.justritemfg.com/databasephotos/originals/26800.jpg.

Justrite, Cease-Fire Waste Receptacles, #26800: Smokers Cease-Fire Cigarette Butt Receptacle with Galvanized Steel Liner Pail, Justrite Manufacturing Company, L.L.C., http://www.justritemfg.com/products.tpl? ... Bdoortype%2Btitle &wsgroup1datarg=smokers.

The No Butts Bin Company.

Smokers' Outpost, Smokers' Outpost 0603 and Litter-Mate 0607, CSL Inc. Environmental Products, Cleaning & Maintenance Management, Jul. 2000.

Ash & Trash, Johnsons Environmental Products, Inc.

SMOKING-WASTE RECEPTACLE

BACKGROUND OF THE INVENTION

1. Field of the Invention

The present invention relates to a smoking-waste receptacle and, more particularly, to a smoking-waste receptacle having a baffle system.

2. Description of Related Art

Smoking-waste receptacles are often provided in public spaces so that smokers can dispose of smoking waste, e.g., lit cigarettes or cigarette butts. conventional smoking-waste receptacles have numerous shortcomings.

For example, a conventional smoking-waste receptacle provides a bed of sand into which a smoker can insert a lit cigarette to extinguish the cigarette. The smoking waste is then left in the sand. Such smoking-waste receptacles are not highly desirable because they require the servicer to bend over, take the unit apart, and sift through the sand to remove the smoking waste. This process can be unsanitary and time consuming. Also, the process typically requires some type of accessory tool, which results in increased costs. Also, the servicer may be required to perform movements that are ergonomically undesirable.

Another conventional smoking-waste receptacle has a container for receiving smoking waste, which is disposed within a housing. The container may not extinguish the smoking waste as expeditiously as desired. Also, tools may be needed to remove smoking waste, which requires undesirable cost and effort. The servicer may be required to perform movements that are ergonomically undesirable.

SUMMARY OF THE INVENTION

An aspect of the present invention relates to a smoking-waste receptacle including a housing and a container for receiving smoking waste and that can be inserted into and removed from the housing. The container includes a removal opening that permits removal of smoking waste deposited in the container and a door movable relative to the removal opening and configured to cover the removal opening when the container is disposed in the housing.

Another aspect of the present invention relates to a smoking-waste receptacle including a housing and a container for receiving smoking waste and that can be inserted into and removed from the housing. The container includes a container body and flow-inhibiting structure disposed within the container body to inhibit smoke from leaving the container body.

Yet another aspect of the present invention relates to a smoking-waste receptacle including a container for receiving smoking waste. The container includes a first wall extending substantially vertically, a first insertion opening in the first wall that allows smoking waste to be inserted into the container, and a first snuff member disposed within the container and adjacent the first insertion opening at a position that permits smoking waste that has been inserted into the first insertion opening to be pushed against the first snuff member.

BRIEF DESCRIPTION OF THE DRAWINGS

The accompanying drawings, which are incorporated in and constitute a part of this specification, illustrate a preferred embodiment of the invention and together with the description, serve to explain principles of the invention.

DETAILED DESCRIPTION OF PREFERRED EMBODIMENTS

Figure 1:
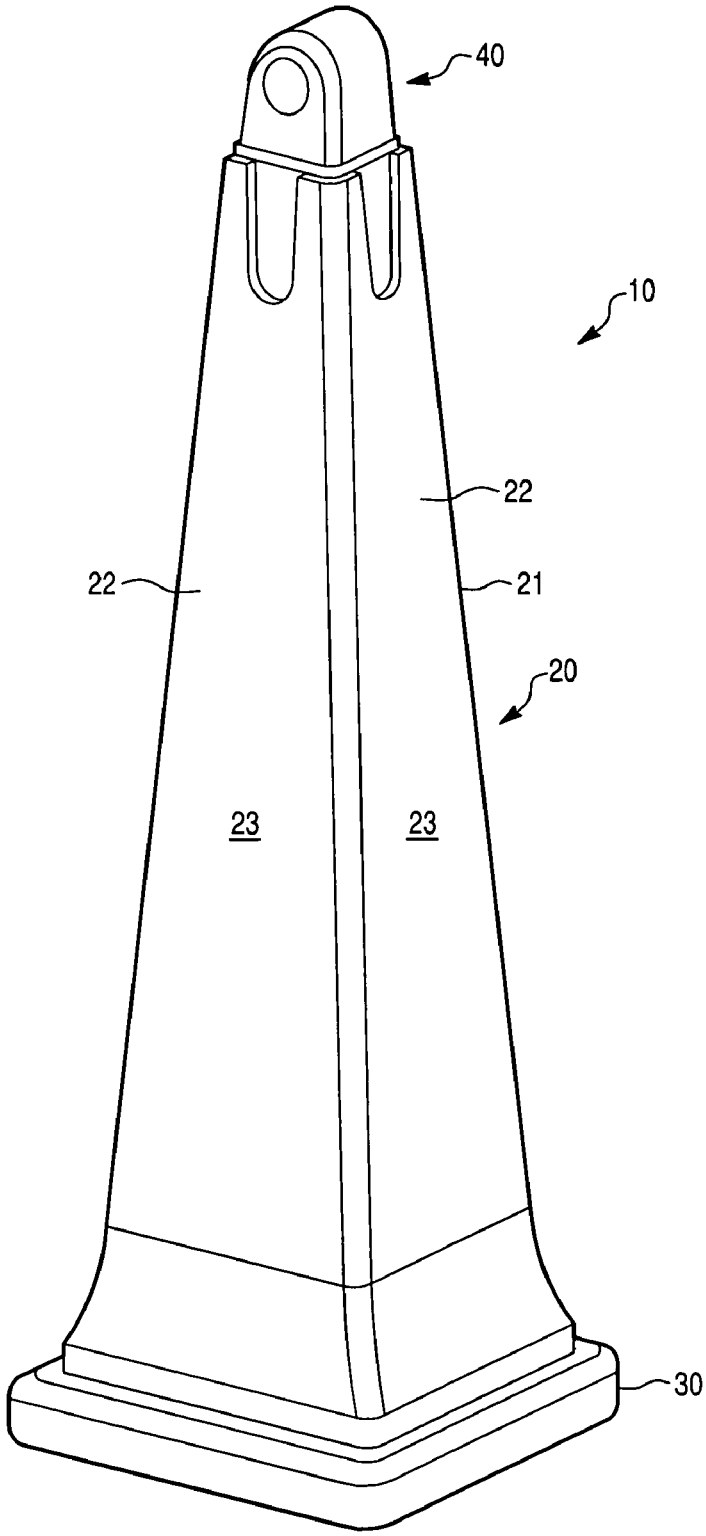
FIG. 1 is a perspective view of an embodiment of a smoking-waste receptacle according to the present invention.

Reference will now be made in detail to presently preferred embodiments of the invention, examples of which are illustrated in the accompanying drawings. An effort has been made to use the same reference numbers throughout the drawings to refer to the same or like parts.

FIGS. 1 to 3, 5 to 15, and 18 to 20 show a first preferred embodiment of a smoking-waste receptacle 10 according to the present invention. In this embodiment, the smoking-waste receptacle 10 includes a housing 20, a support base 30, and a container 40 for receiving smoking waste and that can be inserted into and removed from the housing.

The housing 20 preferably supports the container 40 and can provide an aesthetically pleasing appearance. The housing 20 can be, for example, a four sided cone 21 having four side walls 22. The cone 21 is preferably substantially hollow, which provides the desirable feature of relatively light weight. In particular, the distance between side walls 22 of the cone 21 and the container 40 preferably increases from a top toward a bottom of the cone 21 (see FIG. 2). The housing 20 can be made of plastic that provides a smooth surface that is easy to clean, and fade resistant. A preferred plastic is high density polyethylene. When made of such plastic, the housing 20 can be formed by injection molding.

The cone 21 can have a message displaying surface 23 on an exterior portion, e.g. one of the side walls 22. The message displaying surface 23 can be a substantially flat vertical side that could allow for messages, such as, "No Smoking Beyond This Point," or provide space for branding.

The housing 20 can have an access hole 24 at a top portion 25, preferably at the top center, to allow insertion of the container 40. The access hole 24 has a rim 26 that grips an upper portion of the container 40 when the container 40 is fully inserted into the housing 20.

The support base 30 preferably assists in supporting both the housing 20 and the container 40 and assists in maintaining them in vertically upright positions. The support base 30 is preferably made of metal. It also can be provided with weight(s) (not shown) to enhance stability.

The container 40 provides a receptacle for smoking waste, such as burning cigarettes. The container 40 is preferably made of metal. It could, however, be made of plastics, fiberglass, or another non-contributing material. The container 40 preferably survives a fire long enough to snuff it out, but is durable enough to survive impact testing.

Figure 4:
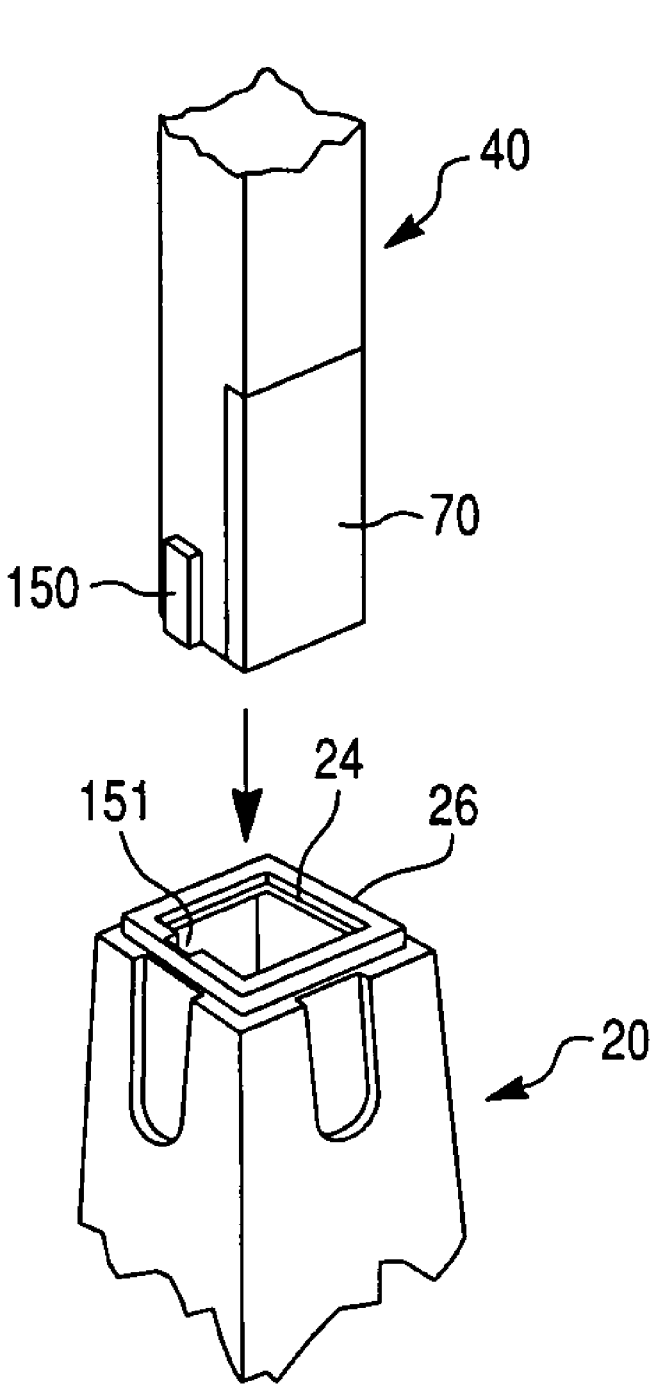
FIG. 4 is a perspective view of a portion of a housing and a portion of a container having an alternative configuration.
Figure 5:
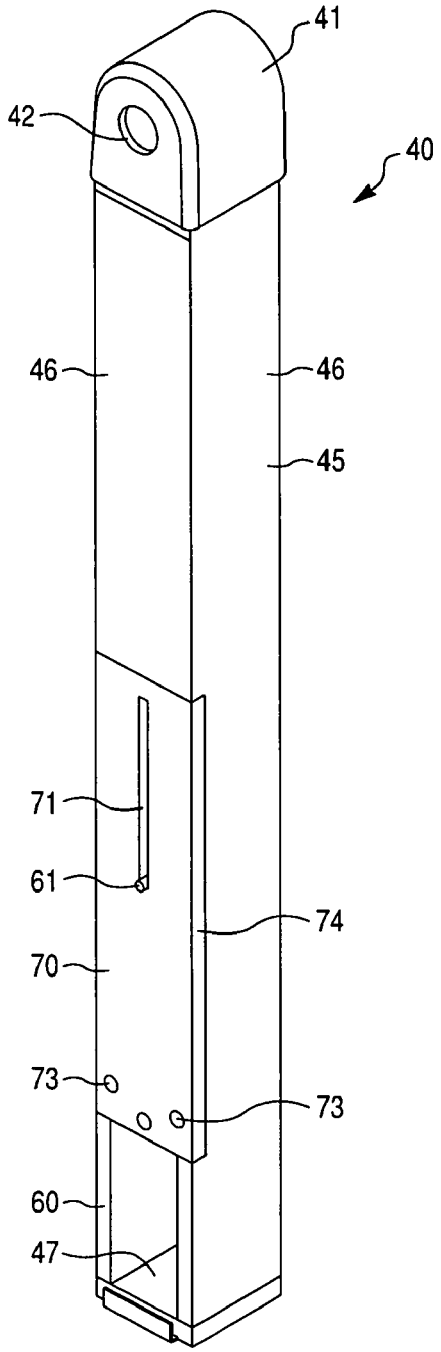
FIG. 5 is a perspective view of the container of the smoking-waste receptacle of FIG. 1 with a door in an open position.
Figure 6:
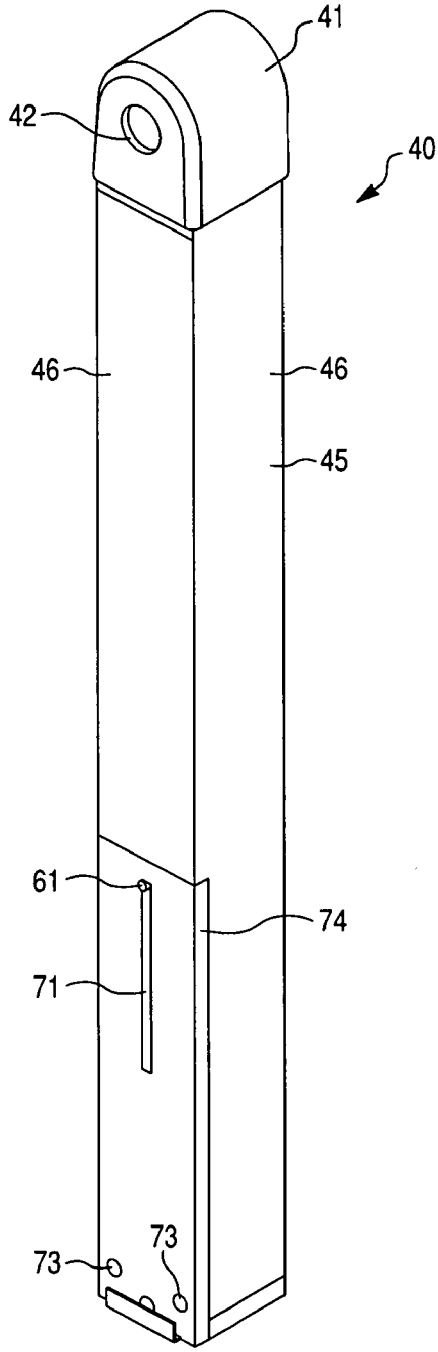
FIG. 6 is a perspective view of the container of the smoking-waste receptacle of FIG. 1 having the door in a closed position.
Figure 7:
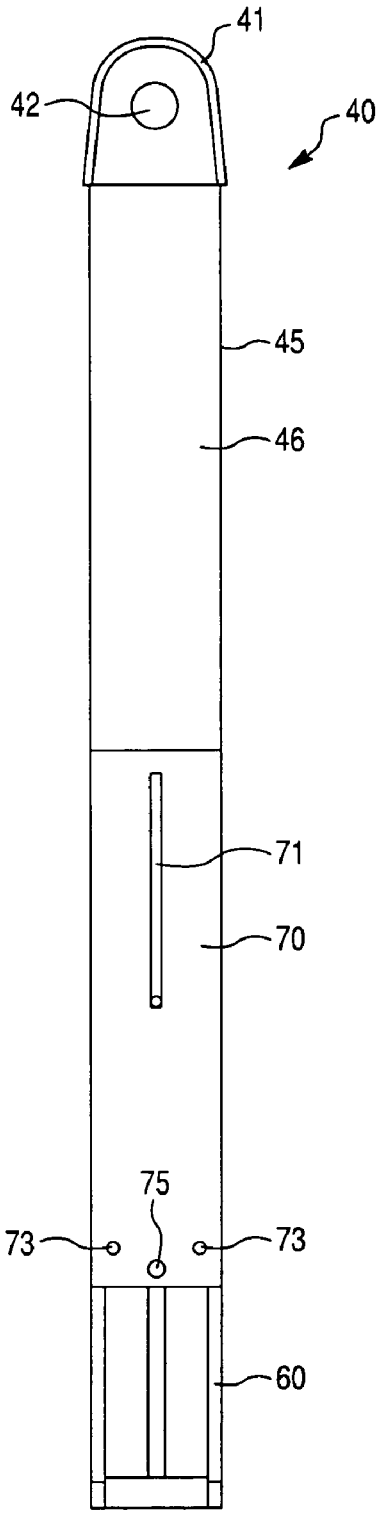
FIG. 7 is a front view of the container of the smoking-waste receptacle of FIG. 1.
Figure 8:
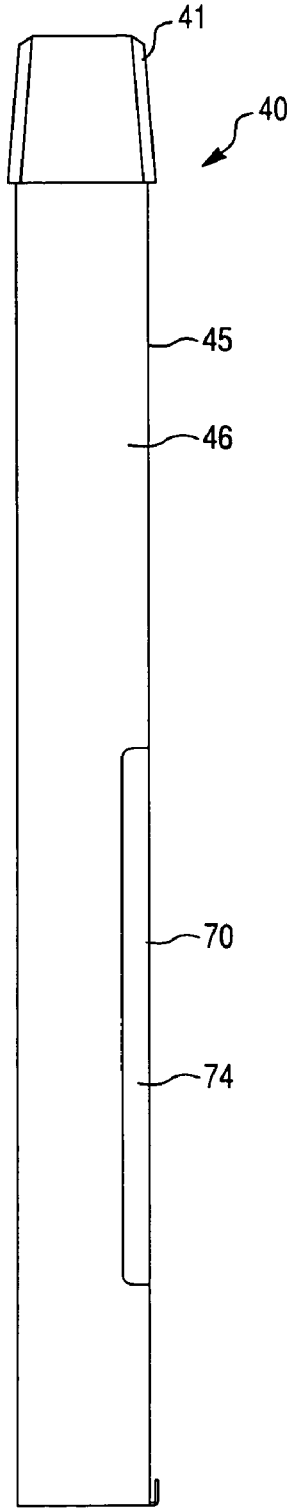
FIG. 8 is a side view of the container of the smoking-waste receptacle of FIG. 1.
Figure 9:
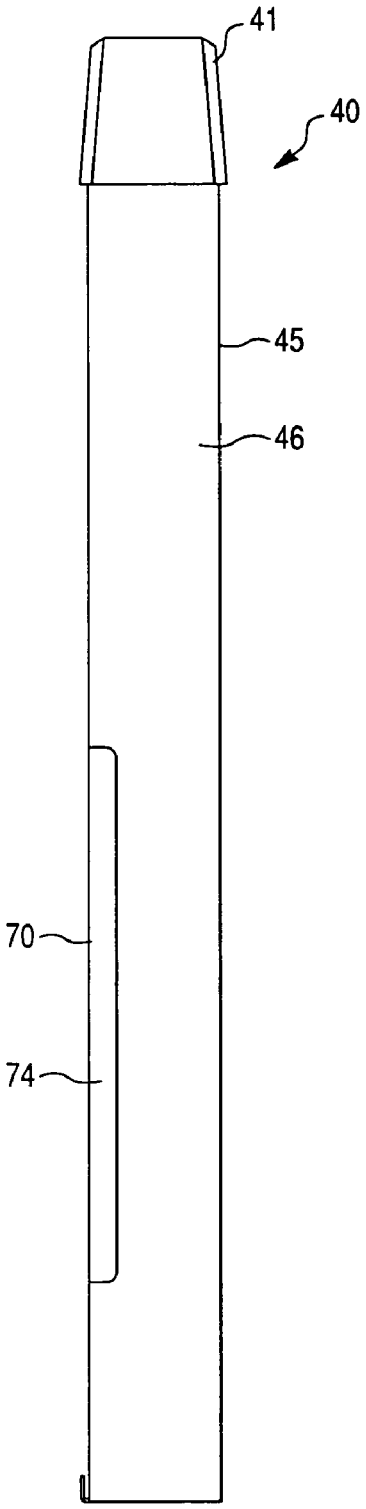
FIG. 9 is a side view of the container of the smoking-waste receptacle of FIG. 1.
Figure 10:
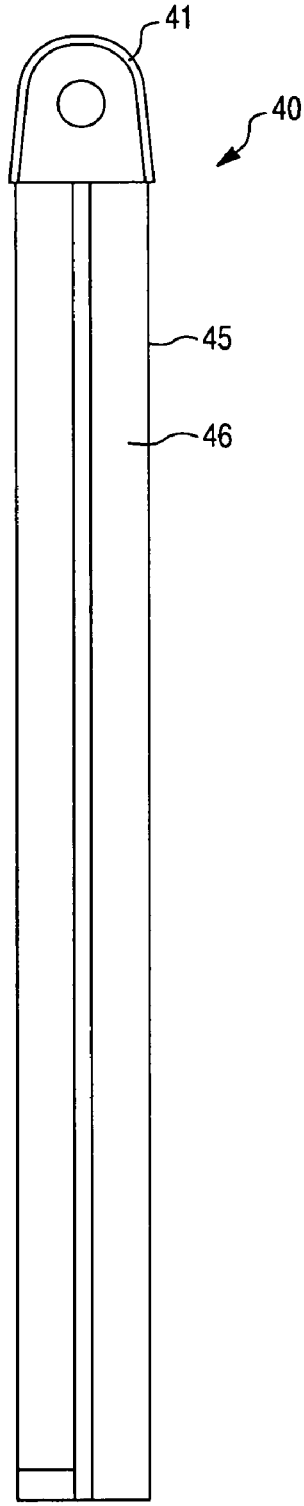
FIG. 10 is a rear view of the container of the smoking-waste receptacle of FIG. 1.

The container 40 can be inserted into the access hole 24 in the housing 20. See FIG. 3. A width of an upper portion 43 (see FIG. 2) of the container 40 is preferably greater than a width of a lower portion 44 of the container-40 such that the rim 26 does not grip the lower portion 44 of the container 40 as the container 40 is inserted into the housing 20, but will grip the upper portion 43 when the container is fully inserted into the housing 20. The tapering of the container 40 from a larger width to a smaller width allows a door 70 (discussed below) sufficient clearance to pass through the rim 26 of the access hole 24, while the rim 26 will still snugly hold the top portion of the container 40 when it is fully inserted into the housing 20. Alternatively, conventional snap or twist lock (not shown) could be used to hold the container 40 in the housing 20. As shown in FIG. 4, a key 150 can be provided on the container 40 that mates with a slot 151 on the housing 20 to ensure that the container 40 is inserted only in a predetermined orientation.

The container 40 can have a top member 41 and a container body 45. The container 40 preferably has four side walls 46, i.e., first through fourth walls, that provide a substantially square cross-sectional shape. The container could, however, have an alternate cross-sectional shape, e.g., circular, rectangular, or oval.

The top member 41 limits flow of fluid and other items into and out of the container 40. The top member 41 can be made of, for example, die cast aluminum. The top member 41 has at least one insertion opening 42, which can be disposed on a wall 46 of the container 40. There are preferably two insertion openings 42, i.e., first and second openings. The insertion opening 42 permits smoking waste to be deposited within the container 40, while limiting fluid flow. The insertion opening 42 is preferably large enough that burning materials can be deposited, yet small enough to limit the amount of smoke (from burning materials deposited in the container 40) that can exit the container 40. Preferably the insertion opening has a circular shape with a diameter in the range of approximately 0.75 to 1.75 inches (an area of approximately 0.4 to 2.4 square inches) and more preferably a diameter in the range of approximately 1.0 to 1.5 inches (an area of approximately 0.8 to 1.8 square inches).

Figure 11:
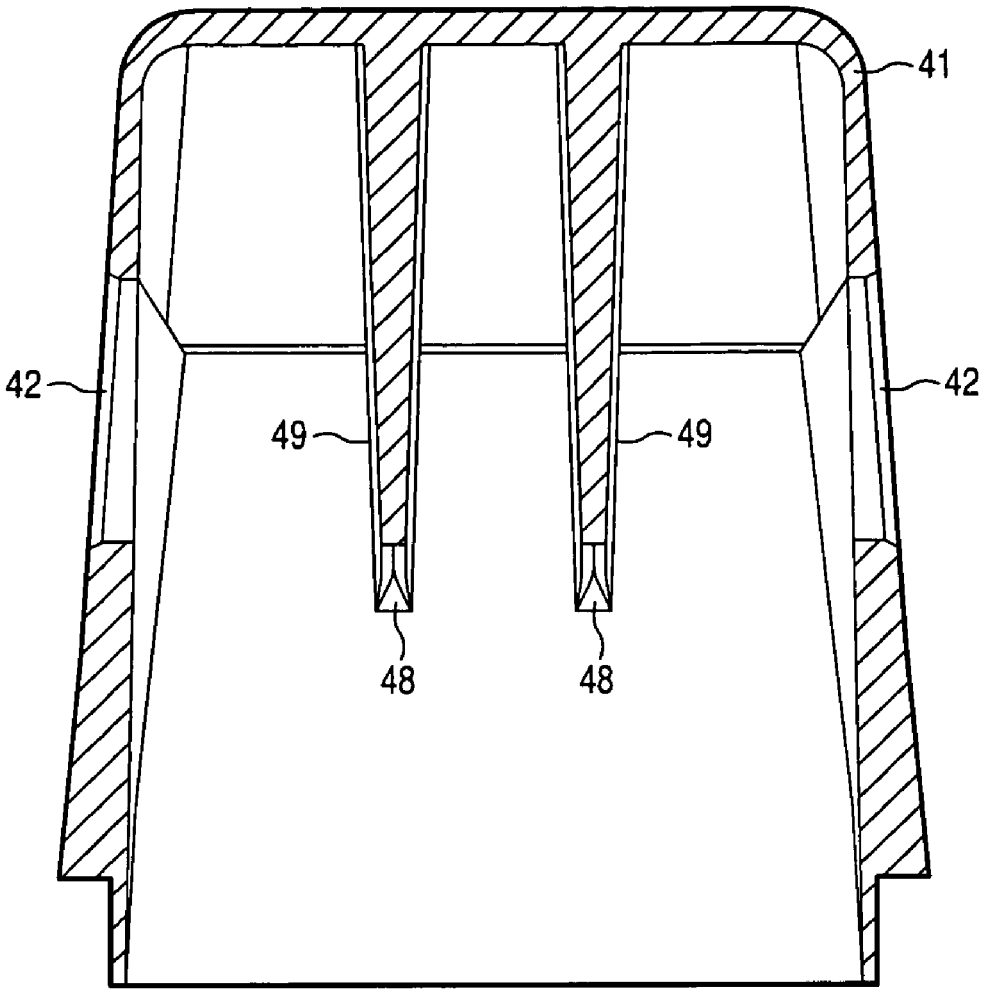
FIG. 11 is a cross-sectional view of a top member of the smoking-waste receptacle of FIG. 1.

A snuff member 48 can be disposed within the container 40 (see FIG. 11). There are preferably two snuff members 48, i.e., first and second snuff members. For example, the snuff member 48 can be a plate 49 extending substantially vertically and being horizontally displaced relative to the insertion opening 42. The snuff member 48 can be disposed adjacent the insertion opening 42 at a position (e.g., approximately one inch from the opening) that inhibits flow of fluid through the container 40 and that permits smoking waste that has been inserted into the insertion opening 42 to be pushed against the snuff member 48.

The container body 45 preferably has four side walls 46 and a bottom wall 47. The container body 45 can be made, for example, from sheet metal formed into a desired shape and joined at a seam. The container body 45 can be joined to the top member 41 by, for example, rivets (not shown).

Figure 2:
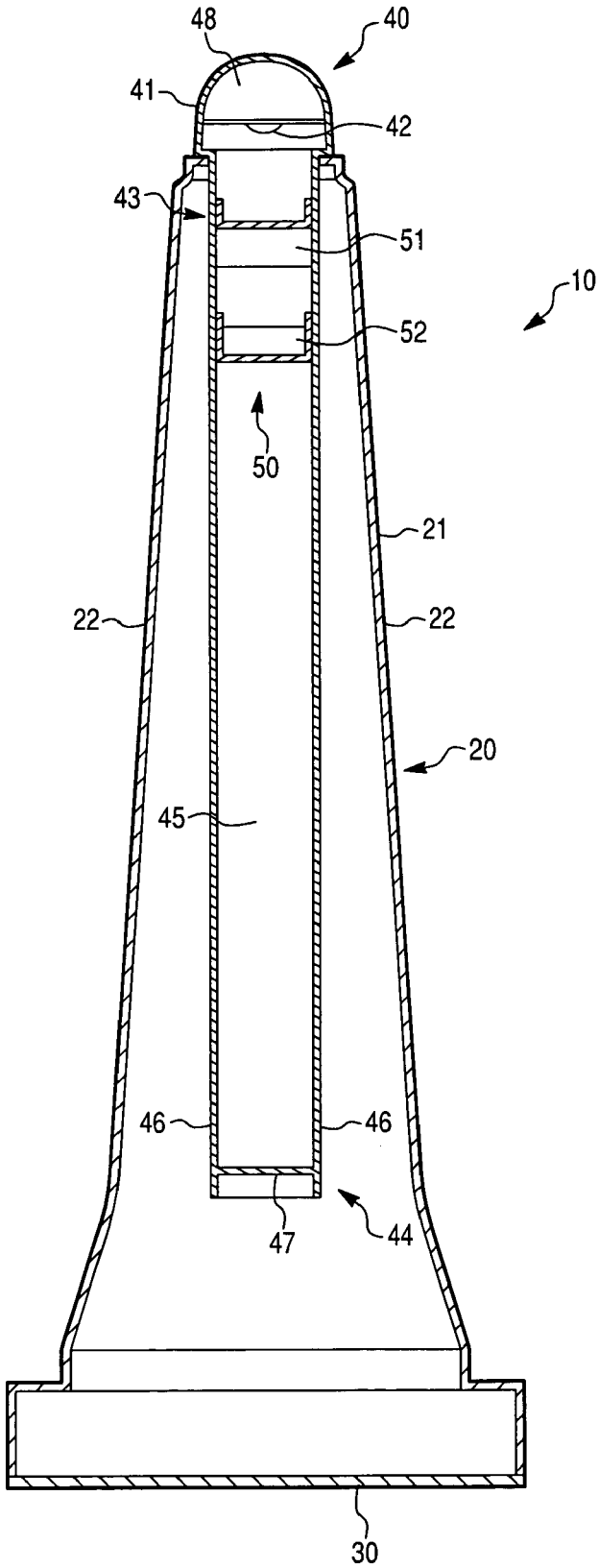
FIG. 2 is a cross-sectional view of the smoking-waste receptacle of FIG. 1.
Figure 3:
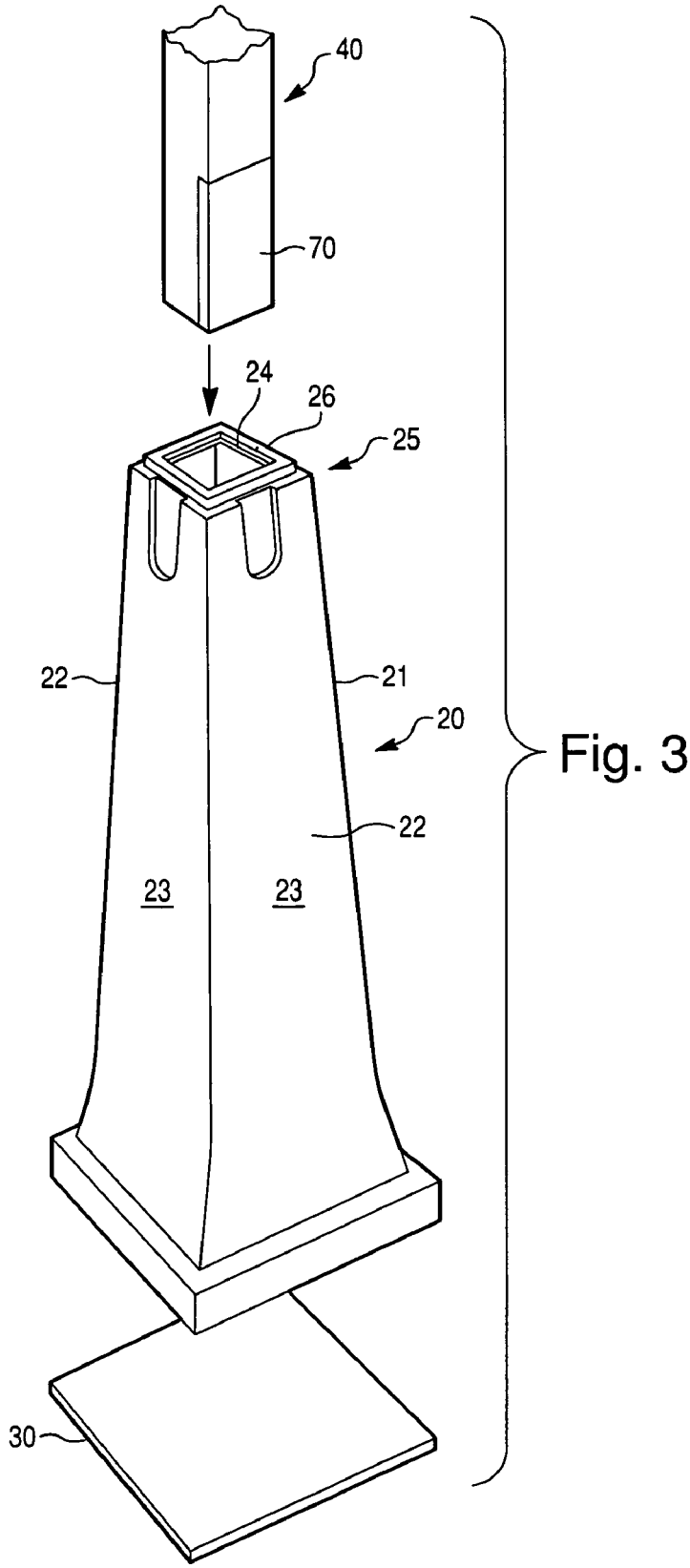
FIG. 3 is a perspective view a housing and a portion of a container of the smoking-waste receptacle of FIG. 1.
Figure 12:
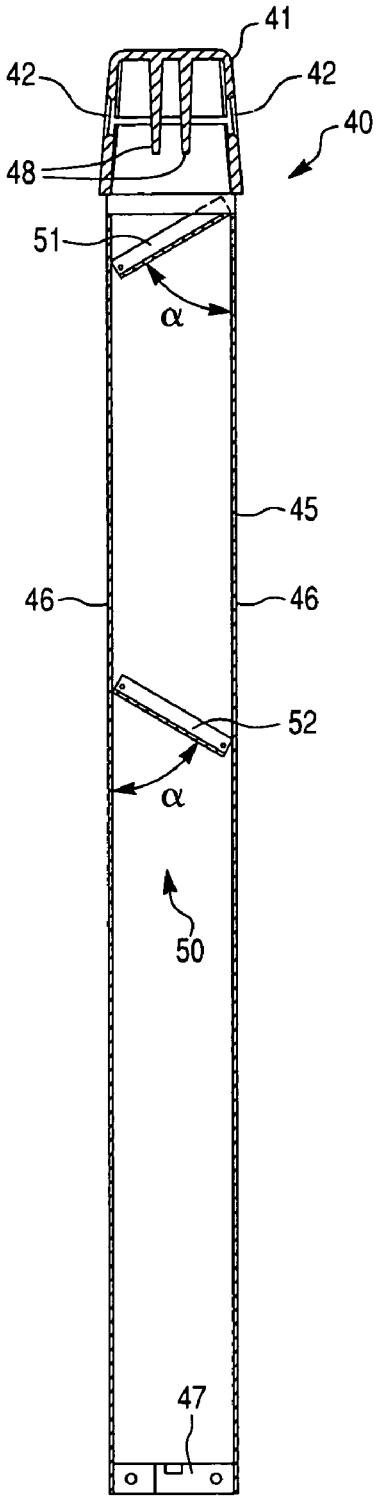
FIG. 12 is a cross-sectional view of the container of the smoking-waste receptacle of FIG. 1.
Figure 13:
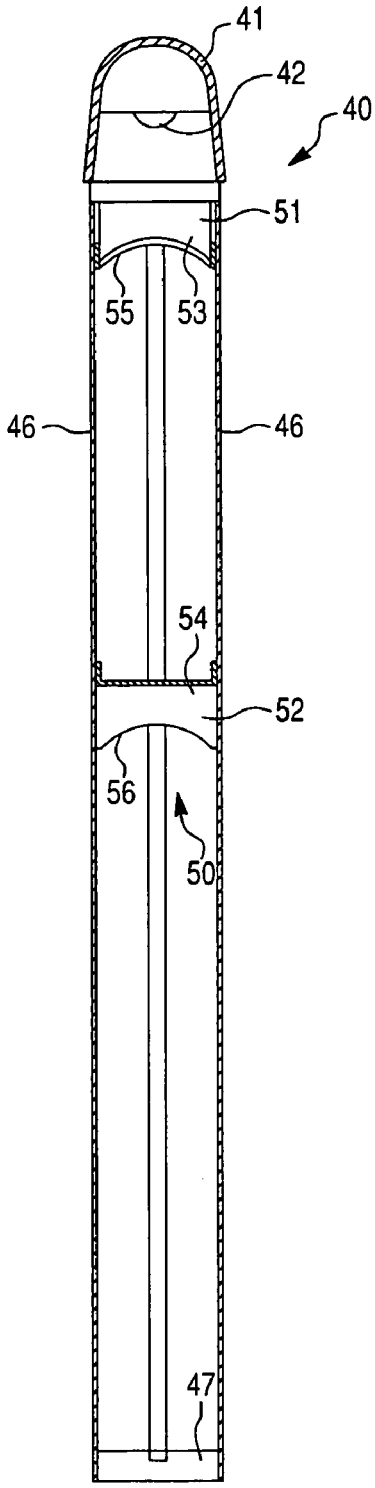
FIG. 13 is cross-sectional view of the container of the smoking-waste receptacle of FIG. 1.

Flow-inhibiting structure 50 can be disposed within the container body 45 and configured to inhibit smoke from leaving the container body 45 (see FIGS. 2, 12, and 13). The trapped smoke can reduce oxygen in the container body 45 and thus can assist in extinguishing burning materials within the container body 45. The flow-inhibiting structure 50 preferably includes a first baffle 51 projecting from a first interior surface of the container body 45 and a second baffle 52 below the first baffle and projecting from a second interior surface of the container body 45. The first baffle 51 and the second baffle 52 project in opposite directions. The first and second baffles 51, 52 may each be formed as generally U-shaped members including side walls that connect to the container body 45 by, for example, spot welding, and a plate 53, 54 that extends downward and at an angle $\alpha$ within the range of 30° to 50°, more preferably about 45°, relative to the corresponding one of the first and second interior surfaces of the container body 45. Though the plates 53, 54 are generally square shaped, they have arcuate cut outs 55, 56 that provide space between the plates 533, 54 and the side walls 46 to permit smoking waste to fall toward the bottom wall 47 of the container body 45. The area of each of the plates 53, 54 is preferably within the range of 7 to 9 square inches. The angles, number of baffles 51, 52 and size of the baffles 51, 52 can be altered from those shown in the drawings.

The container 40 can include a removal opening 60 (see FIG. 5) in one or more of the walls 46 of the container 40. The removal opening 60 permits removal of smoking waste deposited in the container 40. When the container 40 is disposed in the housing 20, the removal opening 60 can be covered by the door 70 to prevent the smoking waste from leaking from the container 40.

The door 70 can be movable relative to the removal opening 60 to provide access to smoking waste within the container body 45 so that the container 40 can be emptied. The door 70 preferably is slidably connected to the container body 45 to move between an open position and a closed position. More preferably, the door 70 is configured to slide from the open position to the closed position under the force of gravity when the container 40 is in an orientation in which the container 40 can be inserted into the housing 20. A pin 61, such as a rivet, projects from the container body 45 and extends into a receiving slot 71 in the door 70. The pin-in-slot connection slidably connects the door 70 to the container body 45. Pins 73, such as rivets, on the door 70 project inwardly and slidably engage walls 46 of the container body 45 around the opening 60 to assist in positioning the door 70 relative to the container body 45. Edges 74 of the door 70 wrap around corners of the container body 45 to further assist in positioning the door 70 on the container body 45 and closing the removal opening 60.

Figure 14:
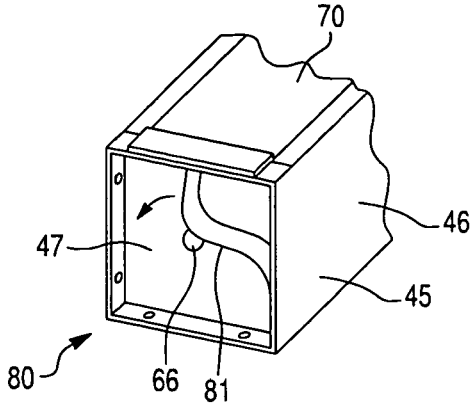
FIG. 14 is a perspective view of the bottom of the container of the smoking-waste receptacle of FIG. 1.
Figure 15:
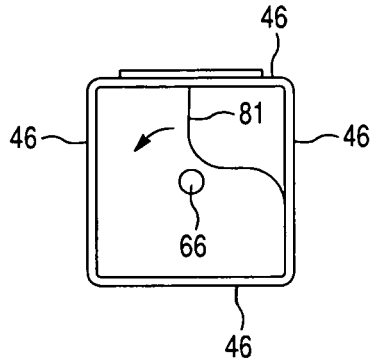
FIG. 15 is a bottom view of the container of the smoking-waste receptacle of FIG. 1.
Figure 18:
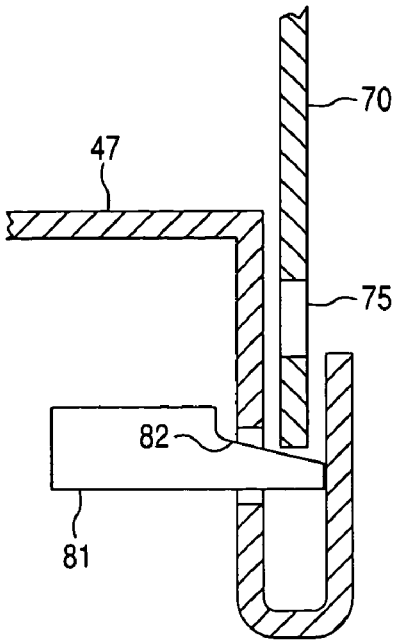
FIG. 18 is a partial cross-sectional view of the spring-locking mechanism of the container of the smoking-waste receptacle of FIG. 1.
Figure 19:
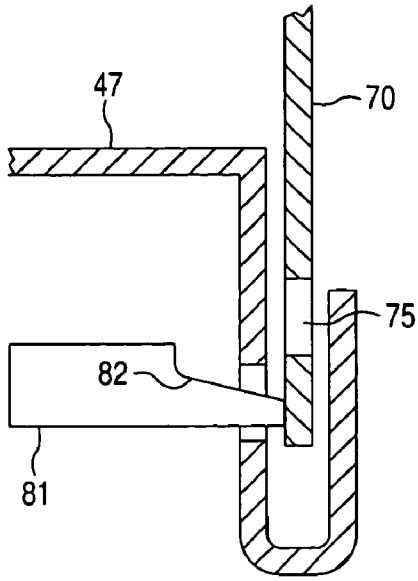
FIG. 19 is a partial cross-sectional view of the spring-locking mechanism of the container of the smoking-waste receptacle of FIG. 1.
Figure 20:
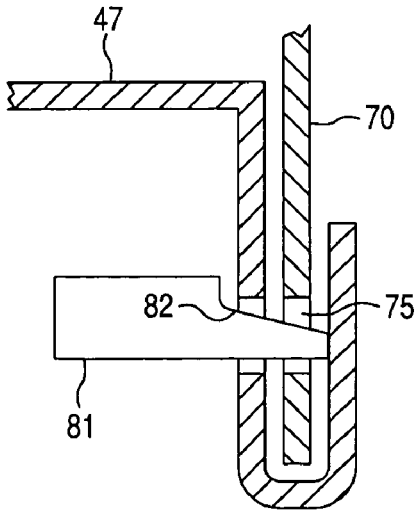
FIG. 20 is a partial cross-sectional view of the spring-locking mechanism of the container of the smoking-waste receptacle of FIG. 1.

A spring-latch mechanism 80 is configured to maintain the door in the closed position. The spring-latch mechanism 80 includes a spring 81 that extends into an engaging portion 75 (preferably a hole) of the door 70 when the door 70 is in the closed position. The spring 81 is preferably connected to a wall 46 of the container body 45 by, for example, spot welding. The spring 81 automatically engages the engaging portion 75 of the door 70 when the door 70 is in the closed position. In particular, as shown in FIGS. 18 to 20, as the door 70 drops toward the closed position its leading edge engages a sloped portion 82 of the spring 81, causing the spring 81 to retract. After the door 70 reaches the closed position where it abuts a bent portion of the bottom wall 47, the spring 81 extends into the engaging portion 75 of the door 70 (see FIG. 20). As shown in FIGS. 14 and 15, the spring 81 can be pushed in the direction of the arrow out of engagement with the engaging portion 75 such that the door 70 can be moved to the open position. When the spring 81 is pushed out of engagement, a pin 66, such as a rivet, projecting from the bottom wall 47 prevents the spring 81 from being over compressed.

Figure 16:
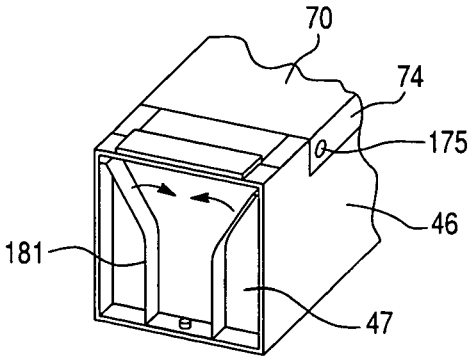
FIG. 16 is a perspective view of the bottom of a container having an alternative spring-locking mechanism.
Figure 17:
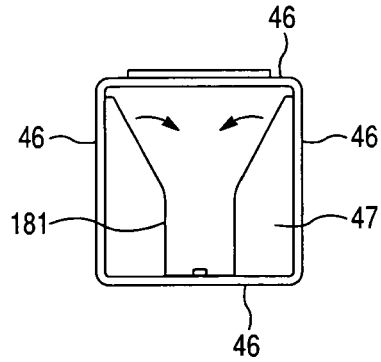
FIG. 17 is a bottom view of the container with the alternative spring-locking mechanism shown in FIG. 16.

FIGS. 16 and 17 show an alternative embodiment of the spring-latch mechanism 80. In this embodiment, the spring 181 extends into engaging portions 175 formed on edges 74 of door 70.

Figure 21:
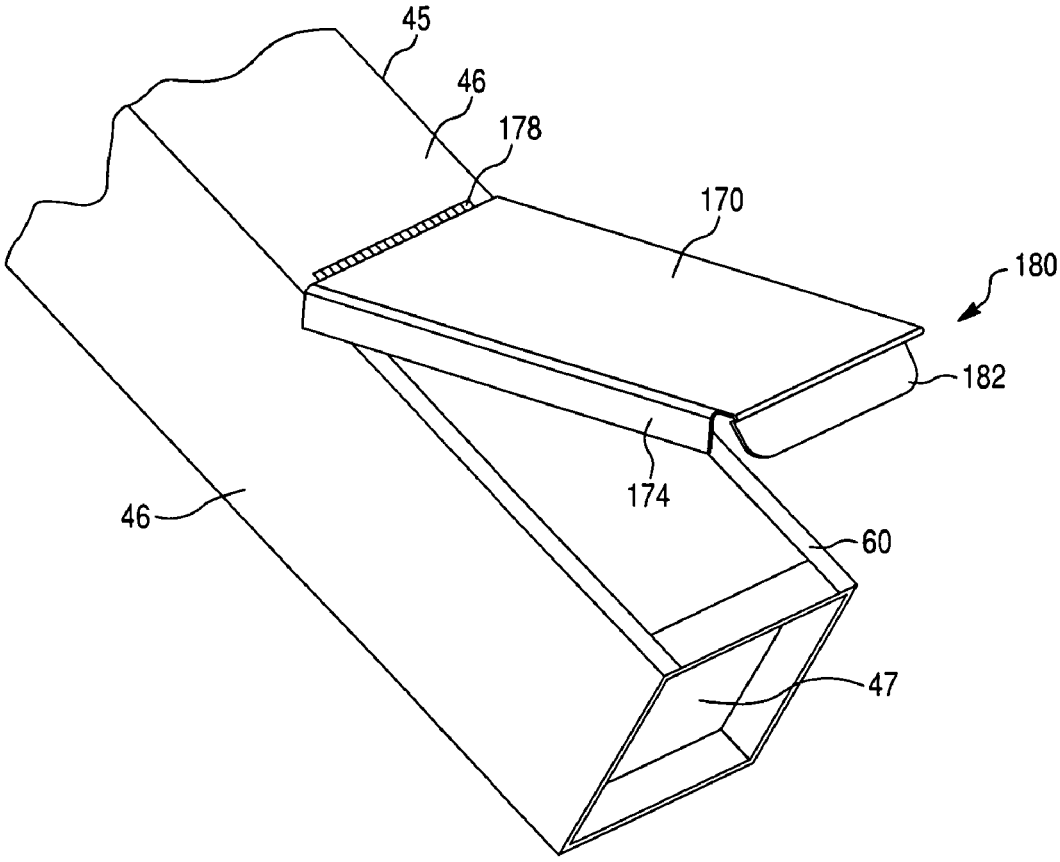
FIG. 21 is a partial perspective view of a container showing an alternative door.
Figure 22:
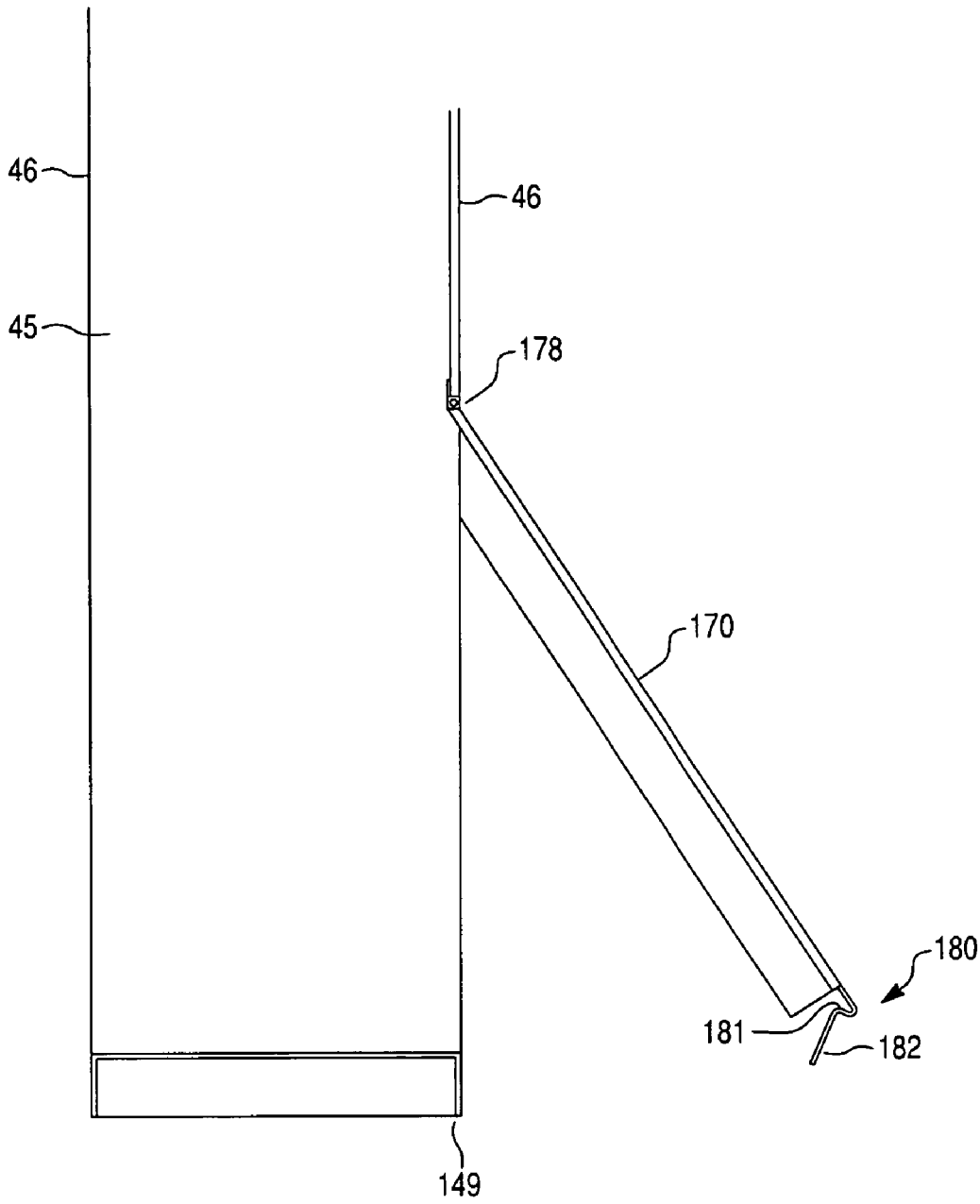
FIG. 22 is a partial cross-sectional view of the container of FIG. 21 with the door in an open position.
Figure 23:
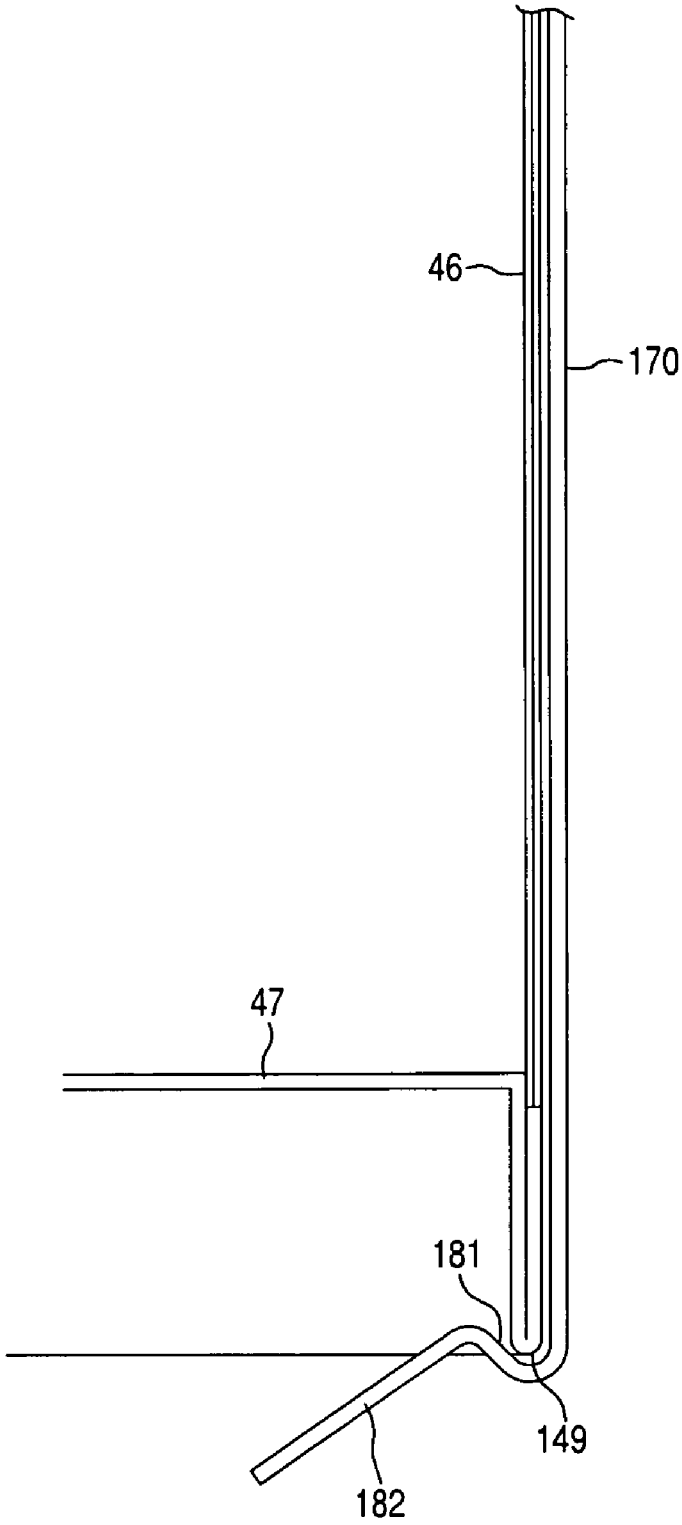
FIG. 23 is a partial cross-sectional view of the container of FIG. 21 with the door in a closed position.

FIGS. 21 to 23 show an alternative embodiment of the door 170. In this embodiment, the door 170 is pivotally connected to the retainer body 45 by a conventional hinge 178 to move between an open position and a closed position. Edges 174 of the door 170 wrap around corners of the container body 45 to further assist in positioning the door 170 on the container body 45 and closing the removal opening 60.

A locking mechanism 180 can be used to hold the door 170 in the closed position. The locking mechanism 180 has an interference portion 181 that engages a corresponding portion 149 of the container 40 to hold the door 170 in the closed position due to engagement. A handle 182 is connected to the locking mechanism 180 such that pressure on the handle 182 biases the interference portion 181 toward a position of reduced engagement between the interference portion 181 and the portion 149 of the container 40 to permit the door 170 to be moved to the open position. When the door 170 is closed, pulling the handle 182 allows the interference portion to be pulled over the portion 149 of the container body 45 and thus permits the door 170 to be opened. The door 170 can be closed by reversing the procedure.

In this embodiment, handle 182 extends below the bottom wall 47 of the container body 45 so as to not interfere with insertion of the container 40 into the housing 20. The container 40 is configured such that the door 170 must be in the closed position to permit insertion of the container 40 into the housing 20, which enhances fire safety.

As described below, there are significant advantages that can be realized by the embodiments set forth above. Of course, it is not necessary for the invention to achieve all or any of these advantages.

The present invention permits configuring a device that allows for the removal of the smoking waste without ergonomically unfriendly efforts, such as bending over. The servicer can, while standing upright, remove the container 40 from the housing 20 and open the door 70, 170. The door 70, 170 can be open by a relatively simple motion, and more difficult motions, such as an unscrewing motion, are not necessary. The present invention thus may minimizes the purchaser's medical costs by using this ergonomic design (no bending or twisting motion).

The present invention also allows for the removal of smoking waste without any accessory tools (e.g., buckets, sand sifters, screw drivers, and allen wrenches). Thus, the cost and effort associated with accessory tools is eliminated. Also, the time needed to remove the smoking waste can be reduced, which may result in decreased expenses.

The design permits servicing without touching unsanitary portions of the ashtray. The servicer merely flips open the access door. The area contacted by the servicer's hand, i.e., an outer surface on the door, is not exposed to the contents of the container 40. Thus, the risk of cross contamination is greatly reduced.

The present invention also can be configured to reduce the likelihood of spills, which would require secondary cleaning. For example, even with the access door 70, 170 open, the contents can be contained while moving the container 40 to a larger fire safe disposal containment unit.

Other embodiments of the invention will be apparent to those skilled in the art from consideration of the specification and practice of the invention disclosed herein. It is intended that the specification and examples be considered as exemplary only.

What is claimed is:

1. A smoking-waste receptacle comprising:

a housing; and a container for receiving smoking waste and that can be inserted into and removed from the housing, wherein the container includes a removal opening that permits removal of smoking waste deposited in the container and a door movable relative to the removal opening and configured to cover the removal opening when the container is disposed in the housing, wherein the housing includes an access hole at a top portion of the housing to permit insertion of the container, the access hole has a rim that grips an upper portion of the container when the container is fully inserted into the housing, and a width of the upper portion of the container is greater than a width of a lower portion of the container such that the rim does not grip the lower portion of the container as the container is inserted into the housing.

2. The smoking-waste receptacle of claim 1, wherein the housing includes a cone formed of plastic.

3. The smoking-waste receptacle of claim 1, wherein the housing includes a substantially hollow cone.

4. The smoking-waste receptacle of claim 3, wherein the cone includes at least one side wall and a distance between the side wall and the container increases from a top toward a bottom of the cone.

5. The smoking-waste receptacle of claim 1, wherein the housing includes a cone having a message displaying surface on an exterior portion.

6. The smoking-waste receptacle of claim 1, wherein the housing is formed of plastic and the container includes a container body formed of fire-resistant material.

7. The smoking-waste receptacle of claim 1, wherein the container includes a container body and the door is slidably connected to the container body to move between an open position and a closed position.

8. The smoking-waste receptacle of claim 1, further comprising a support base weighted to assist in maintaining the housing vertically upright.

9. The smoking-waste receptacle of claim 1, wherein the container includes a container body and the door is pivotally connected to the container body to move between an open position and a closed position.

10. The smoking-waste receptacle of claim 9, wherein the door includes a locking mechanism with an interference portion that engages a corresponding portion of the container to hold the door in the closed position due to engagement, and a handle connected to the locking mechanism such that pressure on the handle biases the interference portion toward a position of reduced engagement between the interference portion and the corresponding portion to permit the door to be moved to the open position.

11. The smoking-waste receptacle of claim 10, wherein the container includes at least one side wall and a bottom wall, the removal opening is disposed in the at least one side wall, and the handle extends below the bottom wall so as to not interfere with insertion of the container into the housing.

12. The smoking-waste receptacle of claim 9, wherein the container is configured such that the door must be in the closed position to permit insertion of the container into the housing.

13. A smoking-waste receptacle comprising:

a housing; and a container for receiving smoking waste and that can be inserted into and removed from the housing, wherein the container includes a removal opening that permits removal of smoking waste deposited in the container and a door movable relative to the removal opening and configured to cover the removal opening when the container is disposed in the housing, wherein the container includes a container body and the door is slidably connected to the container body to move between an open position and a closed position, wherein the door is configured to slide from the open position to the closed position under the force of gravity when the container is in an orientation in which the container can be inserted into the housing.

14. A smoking-waste receptacle comprising:

a housing; and a container for receiving smoking waste and that can be inserted into and removed from the housing, wherein the container includes a removal opening that permits removal of smoking waste deposited in the container and a door movable relative to the removal opening and configured to cover the removal opening when the container is disposed in the housing, wherein the container includes a container body and the door is slidably connected to the container body to move between an open position and a closed position, wherein the container includes a pin that projects from the container body and extends into a receiving slot in the door to slidably connect the door to the container body.

15. A smoking-waste receptacle comprising:

a housing; and a container for receiving smoking waste and that can be inserted into and removed from the housing, wherein the container includes a removal opening that permits removal of smoking waste deposited in the container and a door movable relative to the removal opening and configured to cover the removal opening when the container is disposed in the housing, wherein the container includes a container body and the door is slidably connected to the container body to move between an open position and a closed position, further comprising a spring-latch mechanism configured to maintain the door in the closed position, wherein the spring-latch mechanism includes a spring that extends into an engaging portion of the door when the door is in the closed position.

16. A smoking-waste receptacle comprising:

a housing; and a container for receiving smoking waste and that can be inserted into and removed from the housing, wherein the container includes a container body and flow-inhibiting structure disposed within the container body to inhibit smoke from leaving the container body, wherein the flow-inhibiting structure includes a first baffle projecting from a first interior surface of the container body and a second baffle below the first baffle and projecting from a second interior surface of the container body.

17. The smoking-waste receptacle of claim 16, wherein the housing includes a cone formed of plastic.

18. The smoking-waste receptacle of claim 16, wherein the housing includes a substantially hollow cone.

19. The smoking-waste receptacle of claim 18, wherein the cone includes at least one side wall and a distance between the side wall and the container increases from a top toward a bottom of the cone.

20. The smoking-waste receptacle of claim 16, wherein the housing includes a cone having a message displaying surface on an exterior portion.

21. The smoking-waste receptacle of claim 16, wherein the flow-inhibiting structure is configured to reduce oxygen content within the container when smoking waste is burning within the container body.

22. The smoking-waste receptacle of claim 16, wherein the first baffle and the second baffle project in an opposite directions.

23. The smoking-waste receptacle of claim 16, wherein the first and second baffles each include a plate that extends downward and at an angle within the range of 30 to 50 relative to the corresponding one of the first and second interior surfaces of the container body.

24. The smoking-waste receptacle of claim 23, wherein the area of the plate of the first baffle and the area of the plate of the second baffle are each in the range of approximately 7 to 9 square inches.

25. The smoking-waste receptacle of claim 16, wherein the container has a top member that limits flow of fluid into the container and has at least one insertion opening on a side thereof that permits smoking waste to be inserted into the container.

26. The smoking-waste receptacle of claim 16, wherein the top member includes a snuff member disposed adjacent the insertion opening at a position that inhibits flow of fluid through the container.

27. A smoking-waste receptacle comprising:

a housing; and a container for receiving smoking waste and that can be inserted into and removed from the housing, wherein the container includes a container body and flow-inhibiting structure disposed within the container body to inhibit smoke from leaving the container body, wherein the container has a top member that limits flow of fluid into the container and has at least one insertion opening on a side thereof that permits smoking waste to be inserted into the container, wherein the insertion opening has an area in the range of approximately 0.4 to 2.4 square inches.

28. A smoking-waste receptacle comprising:

a housing; and a container for receiving smoking waste and that can be inserted into and removed from the housing, wherein the container includes a top member, a bottom wall disposed opposite the top member, at least one side wall between the top member and the bottom wall, a removal opening located in the at least one side wall and that permits removal of smoking waste deposited in the container, and a door movable relative to the removal opening and configured to cover the removal opening when the container is disposed in the housing.

* * * * *